United States Patent [19]

Yamada et al.

[11] 4,097,689

[45] Jun. 27, 1978

[54] OUT-OF-HEAD LOCALIZATION HEADPHONE LISTENING DEVICE

[75] Inventors: Akitoshi Yamada, Daito; Toshiyuki Goto, Katano; Yoichi Kimura, Suita; Yoshinobu Kikuchi, Neyagawa, all of Japan

[73] Assignee: Matsushita Electric Industrial Co., Ltd., Kadoma, Japan

[21] Appl. No.: 656,209

[22] Filed: Feb. 9, 1976

[30] Foreign Application Priority Data

| | | |
|---|---|---|
| Aug. 19, 1975 | Japan | 50-100792 |
| Aug. 27, 1975 | Japan | 50-104377 |
| Aug. 27, 1975 | Japan | 50-104378 |
| Oct. 1, 1975 | Japan | 50-119199 |

[51] Int. Cl.[2] ..... H04R 5/00

[52] U.S. Cl. ..... 179/1 G; 179/1 J

[58] Field of Search ..... 179/1 G, 1 GQ, 1 J, 179/156 R, 100.4 ST, 100.1 TD

[56] References Cited

U.S. PATENT DOCUMENTS

| | | | |
|---|---|---|---|
| 3,088,997 | 5/1963 | Bauer | 179/1 G |
| 3,214,519 | 10/1965 | Fouque | 179/1 G |
| 3,790,711 | 2/1974 | Ojima et al. | 179/1 GP |
| 3,920,904 | 11/1975 | Blauert et al. | 179/1 G |
| 3,924,072 | 12/1975 | Turner et al. | 179/1 G |
| 3,970,787 | 7/1976 | Searle | 179/1 G |

FOREIGN PATENT DOCUMENTS

| | | | |
|---|---|---|---|
| 817,773 | 8/1959 | United Kingdom | 179/1 G |

*Primary Examiner*—Douglas W. Olms
*Attorney, Agent, or Firm*—Stevens, Davis, Miller & Mosher

[57] ABSTRACT

A headphone device comprising a pair of headphones for receiving output signals from various acoustic apparatus, wherein a direct sound signal or an output signal of an acoustic apparatus is applied to a reverberation supply circuit to produce an indirect sound signal, said indirect sound signal being mixed with said direct sound signal with a ratio of more than 1 : 10 to control the feeling of distance to a sound image existing outside the head, and further the direct sound signal is added to another channel through an attenuator to control the feeling of the direction of the sound image, whereby a natural listening condition similar to the case of loudspeaker listening is obtained.

8 Claims, 12 Drawing Figures

OUT-OF-HEAD LOCALIZATION HEADPHONE LISTENING DEVICE

This invention relates to a headphone device in which the output signals of a reproducing means reproducing recorded signals of program sources such as records and magnetic tapes or of various acoustic apparatus are received by headphones.

The first object of this invention is to make the sound image stay outside the head as in the case of listening to a loudspeaker, thereby removing the feeling of fatique inherent in headphone listening.

The second object of this invention is to provide a headphone means which can easily control the distance and direction feelings by adjusting attenuators.

The further objects and advantages of the present invention will be appreciated taken in conjunction with the following accompanying drawings; in which FIG. 1 is a diagram showing the conditions present when loudspeakers are being listened to.

Figure 1:
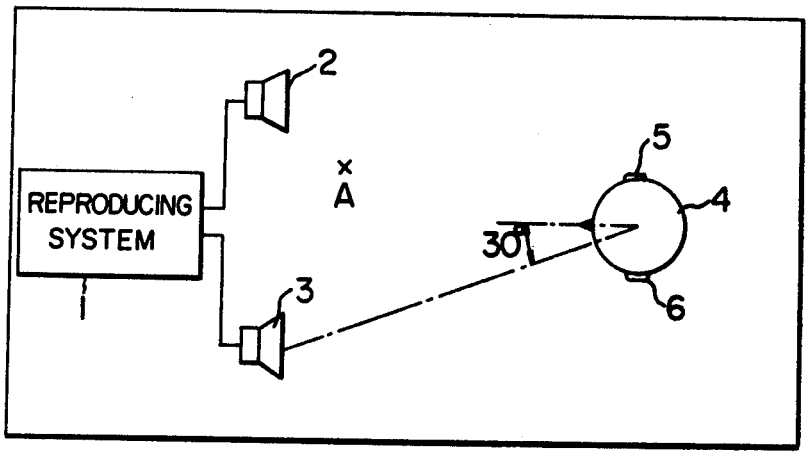

In FIG. 1, which shows a condition of loudspeaker listening by reproducing a program source such as a record and a magnetic tape, 1 denotes a means for reproducing a program source, 2 and 3 are speakers converting left and right signals reproduced by the reproducing means 1 into sound waves, 4 denotes a listener, and 5 and 6 are the ears of the listener. Sound waves radiated from the speakers 2 and 3 are received by the ears 5 and 6 of the listener, who perceives a sound image outside his head, for example, at a point A.

Figure 2:
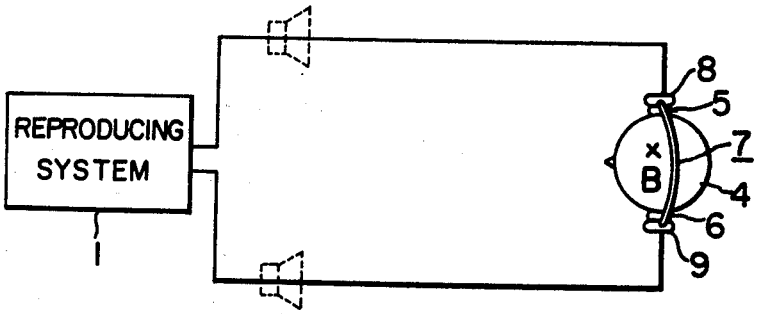
FIG. 2 is a diagram showing the conditions present when headphones are being employed.
Figure 8:
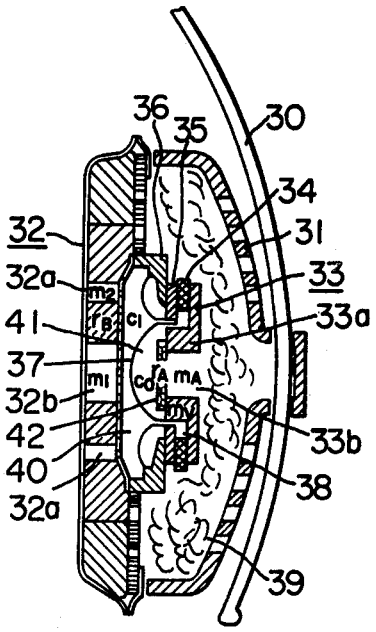
FIG. 8 shows a cross-section of a headphone used in the headphone apparatus of this invention.
Figure 9:
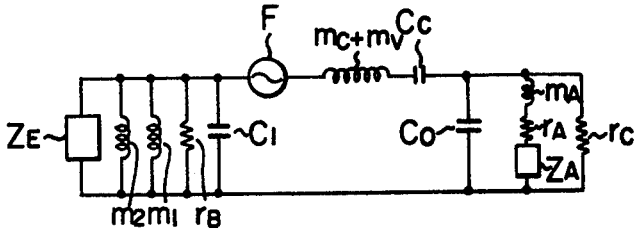
FIG. 9 is an equivalent circuit of the above headphone.

FIG. 2 shows a condition where the same program source as in FIG. 1 is reproduced by a reproducing means 1 and received by headphones 7. As shown in this figure, the listener 4 perceives a sound image inside his head, for example, at a point B. In FIGS. 2, 8 and 9 show left and right electro-acoustic transducers, respectively.

As described above, the locations of sound image are utterly different in the loudspeaker listening shown in FIG. 1 and the headphone listening shown in FIG. 2. The reasons for this are due to (A) lack of information in the headphone listening.

(B) characteristics inherent to the headphone itself.

Explanation will be made first of (A).

Figure 3:
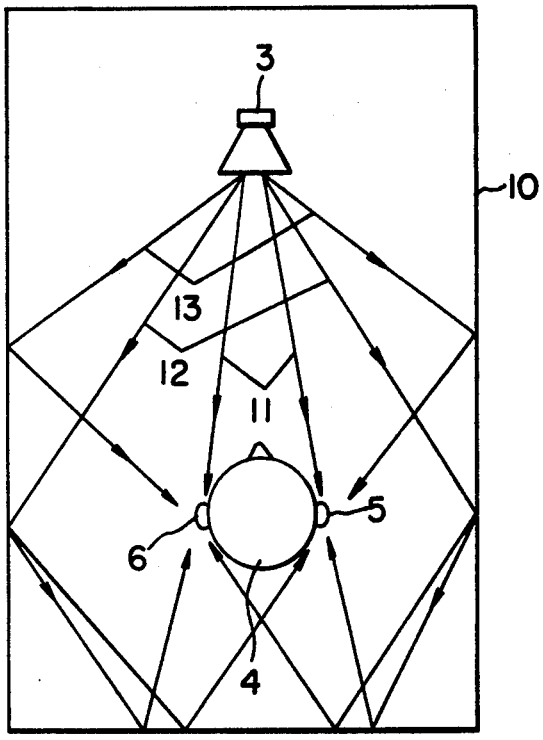
FIG. 3 shows the sound paths in the case of listening to a loudspeaker.

FIG. 3 gives the outline of loudspeaker listening in a room 10. Sounds radiated from the loudspeaker 3 reach left and right ears 5 and 6 of the listener 4 through a multiplicity of sound paths (hereinafter referred to as sound lines) 11, 12 and 13. The sound line 11 is a path on which the sound from the speaker 3 reaches ears 5 and 6 directly, that is, the path of direct sound. The sound lines 12 and 13 are paths on which the sound from the loudspeaker 3 reaches ears 5 and 6 after reflected on the wall of room 10, that is, the paths of indirect sound. The indirect sound reaches ears later than the direct sound, suffering from a phase shift by every reflection on the wall. Due to the acoustic asymmetry of the room, the indirect sounds often have different phases at left and right ears.

In the case of headphone listening shown in FIG. 2, since no indirect sound exists, the sound image is placed inside the head.

Next, explanation will be made of a circuit of FIG. 4, which produces a signal corresponding to an indirect sound (hereinafter referred to as indirect sound signal) in the case of loudspeaker listening and adds it to a signal corresponding to a direct sound (hereinafter referred to as a direct sound signal) in the case of loudspeaker listening.

Figure 4:
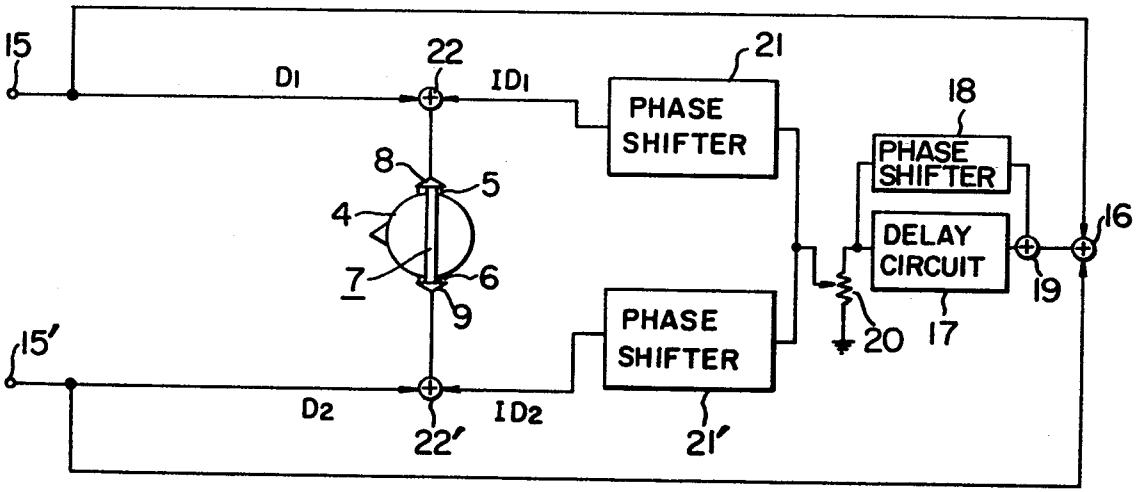
FIG. 4 shows a block diagram demonstrating the main part of a headphone apparatus according to one embodiment of this invention.

In FIGS. 4, 15 and 15′ denote input terminals to which stereo signals reproduced by a reproducing means are applied, 16 is an adder which adds the stereo signals applied at the terminals 15 and 15′, 17 is a delay circuit, 18 is a phase shifter or a resistor, and 19 is a mixer. The delay circuit 17 and the phase shifter or the resistor 18 constitute a reverberation suppling circuit. The output of the delay circuit 17 is fed back through the phase shifter 18 to produce an indirect sound signal having a reverberation effect. The indirect sound signal is attenuated by a variable resistor 20 and supplied to adders 22 and 22′ through phase shifters 21 and 21′ having different phase shift characteristics. At the adders 22 and 22′, the direct sound signals $D_1$ and $D_2$ applied to the input terminals 15 and 15′ and the indirect sound signals $ID_1$ and $ID_2$ are added. The added signals are applied to left and right electro-acoustic transducers 8 and 9 of a headphone 7.

According to experiments by the inventors, when the intensity ratio of direct to indirect sound signals is equal to or more than 10 : 1, the listener in FIG. 4 perceives the sound image outside his head. This ratio can be varied by adjusted the variable resistor 20. As the ratio is varied continuously above 10 : 1, the feeling of distance of the sound image varies successively.

Figure 5:
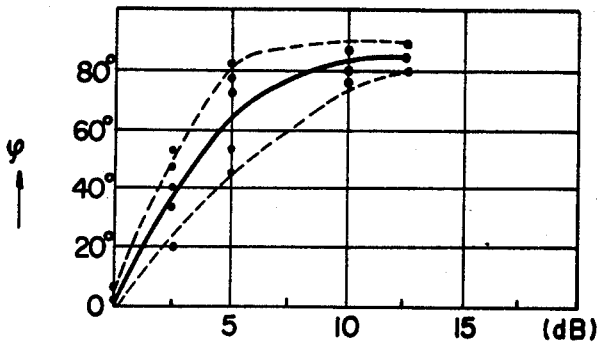
FIG. 5 is a diagram showing the relation between the difference in signal levels at the left and right ears of a person and the direction feeling of a sound image.
Figure 6:
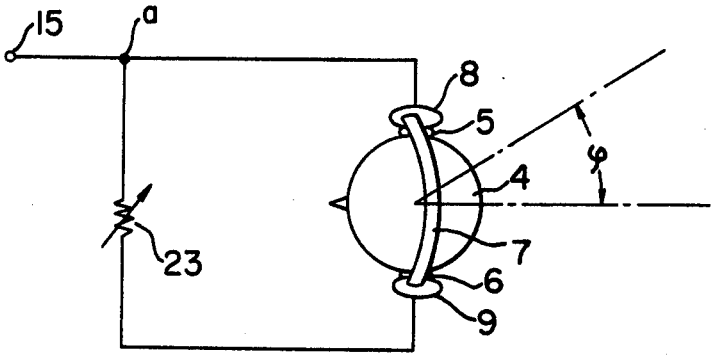
FIG. 6 shows a circuit diagram used to obtain the characteristics shown in FIG. 5.

FIG. 5 shows the variation of direction $\phi$ of the sound image according to the variation of variable resistor 23. Experiments were done as shown in FIG. 6, where a signal applied to the input terminal 15 is divided into two at a point *a*, the one being applied to the right electro-acoustic transducer 8 of the headphone and the other being applied through the variable resister 23 to the left electro-acoustic transducer 9. It was confirmed that as the difference in the levels of the signals applied to both electro-acoustic transducers 8 and 9 is increased, the angle of direction $\phi$ become larger.

Figure 7:
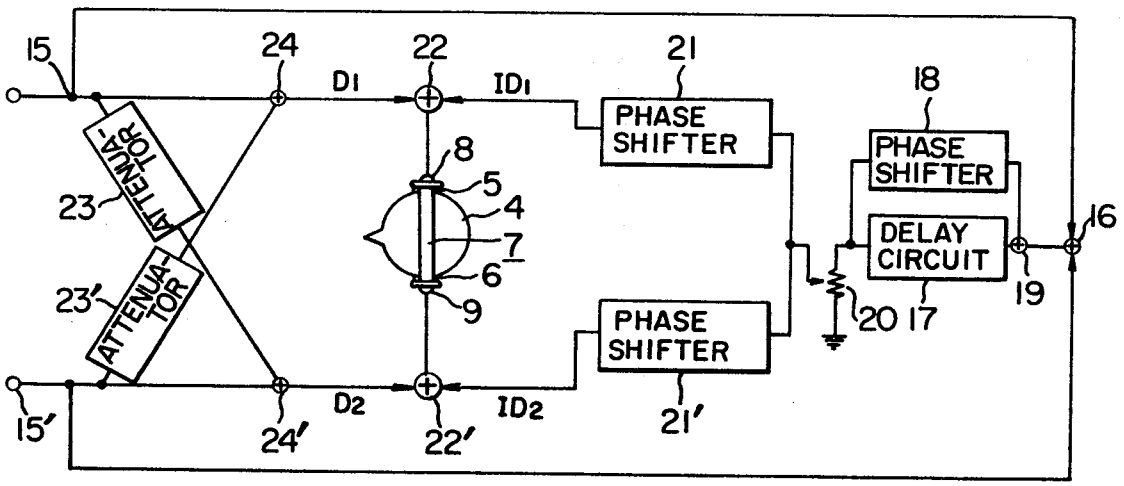
FIG. 7 shows an electric circuit of a headphone apparatus according to another embodiment of this invention.

FIG. 7 shows an electric circuit of headphone apparatus constituted by considering the abovementioned facts. In this figure, it is possible to place the sound image outside the head and to control the feelings of distance and direction. Numerals 23 and 23′ denote attenuaters such as variable resistors, and 24 and 24′ denote adders.

When the electric circuit as shown in FIG. 7 is connected to a usual headphone, substantially the same listening condition as that of a loudspeaker can be realized. However, as pointed out previously by the reason (B), if the characteristics of the headphone itself is selected to be a particular one, a more satisfactory condition of headphone listening becomes possible.

In the conventional case of reproduction by usual loudspeakers, it is desirable that the frequency response of sound pressure of loudspeakers be flat in the range from 20 Hz to 20 kHz. However, if loudspeakers having such a flat response are disposed in front of a listener at an angle of 30° as shown in FIG. 1 and the measurement is made by placing a probe microphone near the entrance of the listener's ear canal, then the resonance in the ear canal and the diffraction of the sound waves by the head and the pinna make a sound pressure-frequency reponse having peaks near 2 kHz and 4 kHz with a sound pressure level difference of 6 to 17 dB from that in the low frequency range. Therefore, if a headphone having such a sound pressure-frequency response is used, the same listening condition as that of a loudspeaker can be obtained.

From this point of view, according to this invention, in the circuit shown in FIG. 7, a headphone whose sound pressure-frequency response has two peaks between 1.5 kHz and 5 kHz with a level difference of 6 to 17 dB above low frequency level is employed.

A headphone having this response is obtained by the structure shown in FIG. 8.

In FIG. 8, 30 is a supporting member, 31 is a headphone case slidably attached to the supporting member 30, 32 is an elastic ear pad of a resilient material such as blistered urethane provided on the front side of the case 31, **32*a* and 32*b* are holes formed in the ear pad 32, 33 is a plate having a center pole 33*a*, 33*b* is a center hole in the center pole 33*a*, 34 is a magnet, 35 is a top plate, 36 is a frame, 37 is a vibration plate, 38 is a voice coil disposed in a magnetic gap formed between the center pole 33*a* and the top plate 35, 39 is a damping material accommodated between the case 31 and the loudspeaker, 40 and 41 are air chambers before and behind the vibration plate 37, and 42 is a damping material provided on the top of the center pole 33*a***.

Expressing the inertance of the center hole **33*b* in center pole 33*a* by $m_A$, the mass of the vibration plate 37 by $m_C$, the mass of voice coil 38 by $m_V$, the acoustic resistances of the brake material 42, the ear pad 32 and the brake material 39 by $r_A$, $r_B$ and $r_C$ respectively, the inertances of holes 33*a* and 33*b* of ear pad 32 by $m_1$ and $m_2$ respectively, the acoustic capacitances of the air chambers 40 and 41 by $C_1$ and $C_0$ respectively, the radiation impedance by $Z_A$, the impedance given by the ear by $Z_E$ and the driving force applied to the vibration system by F, we have an equivalent circuit of the headphone as shown in FIG. 9. In this embodiment, a peak near 2 kHz is formed by adjusting the inertance $m_A$ of center hole 33*b* in the center pole 33*a* and a peak near 4 kHz is formed by adjusting the inertances $m_1$ and $m_2$ of holes 32*a* and 32*b* in the ear pad 32**. Further, by controlling the values of acoustic resistances $r_A$, $r_B$ and $r_C$ a sound pressure-frequency characteristic having peaks at 2 and 4 kHz with a level difference of 6 to 17 dB from the level in the lower frequency range can be obtained, as shown by the solid curve in FIG. 10. In this figure, the broken curve shows a response of a free sound field in the case of loudspeaker arrangement as shown in FIG. 1.

Figure 10:
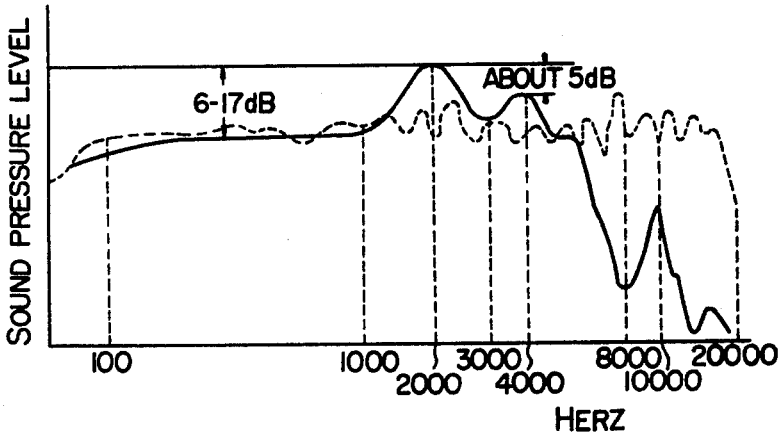
FIG. 10 is a diagram showing the sound pressure-frequency characteristic.

The sound pressure-frequency response near the ear of the listener 4 in this free sound field approximates the solid curve in FIG. 10. Thus, we can make the sound pressure-frequency response of a headphone nearly equal to that of a loudspeaker in the case of free sound field obtained near the ear.

It is needless to say that the same frequency response may be obtained by varying other inertances and acoustic resistances. It was confirmed in any case that, so long as the frequency response has two peaks between 1.5 kHz and 5 kHz and they have a level difference of 6 to 17 dB from that of the lower frequency range, the same feeling of listening can be obtained as in the case of a free sound field.

Namely, in the circuit shown in FIG. 7, if a headphone having such a frequency response as described above is used, the sound image exists at a fixed point outside the head as in the case of loudspeaker listening. Further, the feelings of distance and direction can be controlled freely.

Figure 11:
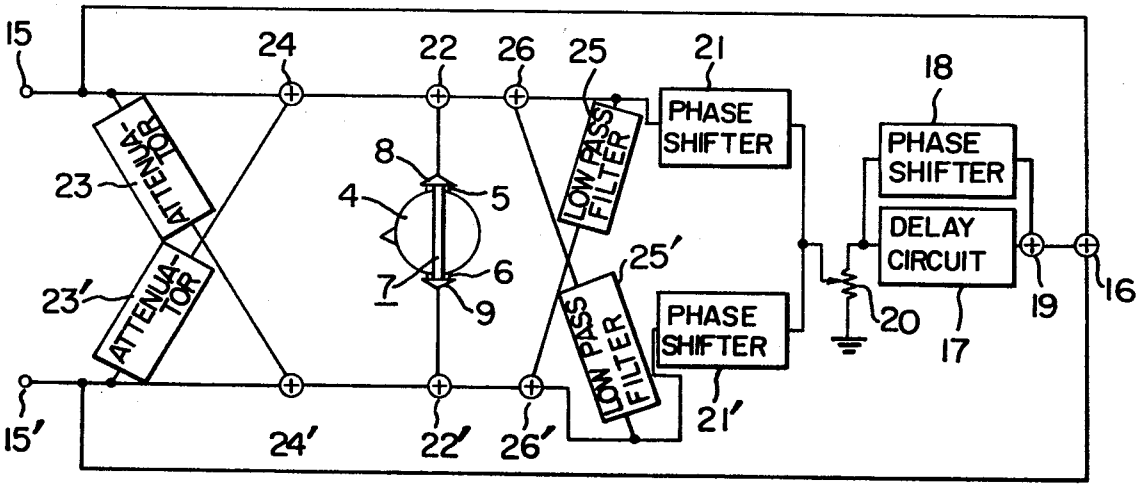
FIGS. 11 and 12 are block diagrams showing still another embodiment of the invention.

FIG. 11 shows another embodiment of this invention which is different from the circuit of FIG. 7 in that the outputs of phase shifters 21 and 21' are respectively added to the other channel by adders 26 and 26' through low pass filters 25 and 25'. The connection of the low pass filters serves to clarify the point of the sound image psychologically.

Figure 12:
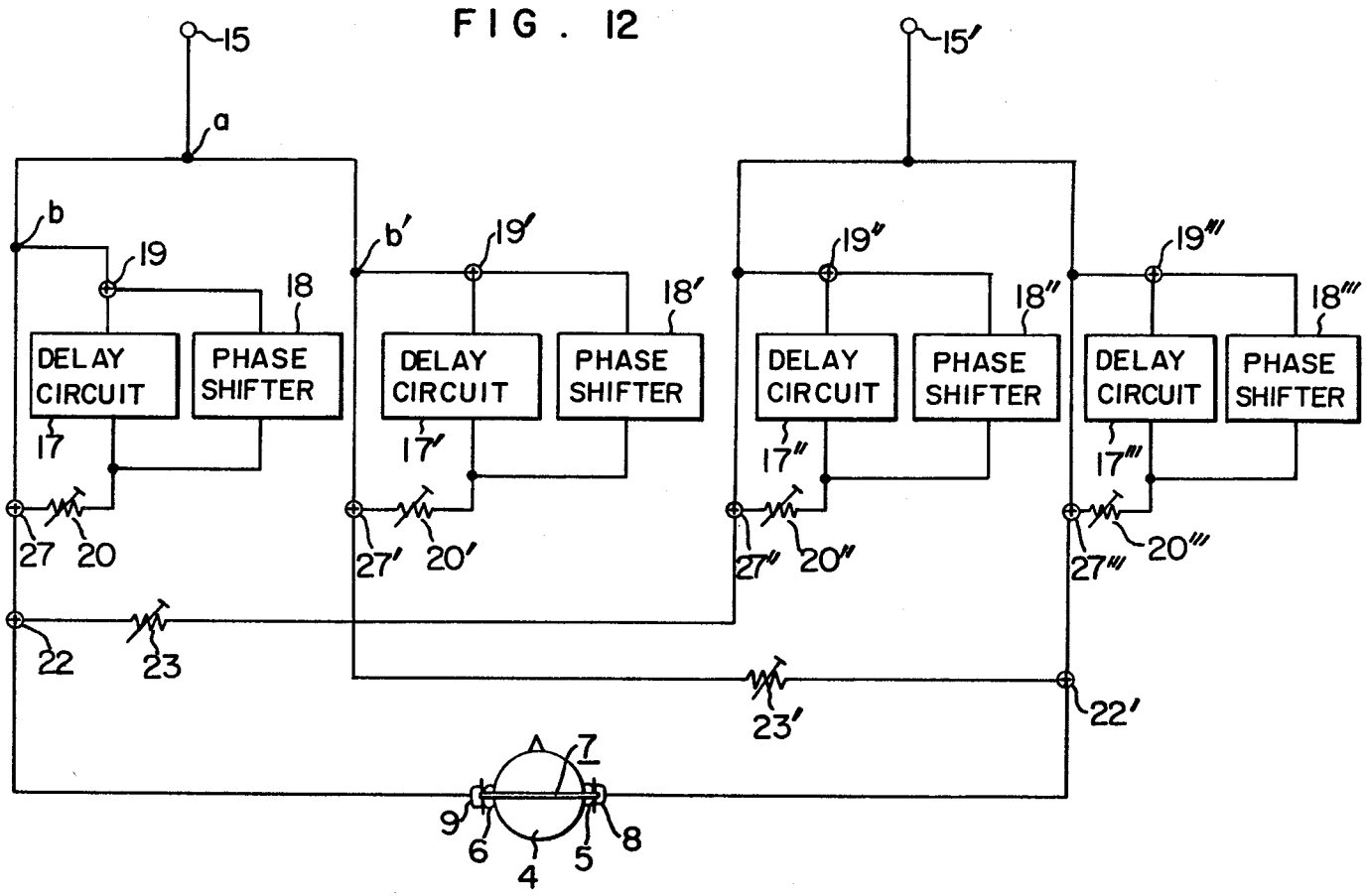

FIG. 12 shows a further embodiment of this invention, in which 15 and 15' are input terminals to which stereo signals reproduced by a reproducing means are applied, 17, 17', 17'' and 17''' are delay circuits, 18, 18', 18'' and 18''' are phase shifters or resistors, 19, 19', 19'', 19''', 27, 27', 27'', 27''', 22 and 22' are adders, and 23, 23', 20, 20', 20'' and 20''' are variable resistors.

In FIG. 12, a signal applied to the input terminal 15 is divided into two at a point *a* to produce two direct sound signals which reach adders 27 and 27'. A part of the direct signal is further subdivided at points *b* and *b'* and applied to adders 27 and 27' through delay circuits 17 and 17' and variable resistors 20 and 20'. The outputs of delay circuits 17 and 17' are fed back to adders 19 and 19' through phase shifters 18 and 18'. Signals applied to adders 27 and 27' through delay circuits 17 and 17' and phase shifters 18 and 18' correspond to indirect sound signals in the case of loudspeaker listening. The direct and indirect sound signals are added at adders 27 and 27'.

In a similar way, a signal applied to the input terminal 15' produces indirect sound signals through delay circuits 17'' and 17''' and phase shifters 18'' and 18'''. The direct and indirect signals are added by adders 27'' and 27'''. The outputs of adders 27' and 27'' are added to signals of other channels by adders 22 and 22' through resistors 23 and 23' respectively. The outputs of adders 22 and 22' are applied to left and right electro-acoustic transducers 9 and 8 respectively.

Variable resistors 20, 20', 20'' and 20''' are provided to adjust the mixing ratio of indirect with direct sound signals and vary the feeling of distance to the sound image. On the other hand, the feeling of the direction of a sound image is varied by adjusting the variable resistors 23 and 23'.

The headphone apparatus of the present invention having the above-mentioned arrangement yields the following effects.

1. Since the indirect sound signal is mixed with the direct sound signal at a ratio of the indirect signal to the direct signal of more than 1 : 10, the sound image is placed at a point outside the head and a feeling of fatigue inherent in conventional headphone listening can be removed.

2. The feeling of distance to the sound image can be easily controlled by adjusting attenuators.

3. The feeling of the direction of the sound image can be easily controlled by adjusting the attenuators.

4. Although the fixed points of the sound image in the case of headphone listening are determined inherent to each listener, the headphone of the present invention can easily give an optimum listening condition.

What is claimed is:

1. A headphone device characterized in that two direct sound signals obtained by reproducing a program source are mixed into the other channels through first and second attenuators respectively, each of said direct sound signals being applied to a reverberation supplying circuit to produce an indirect sound signal, each of said indirect signals being mixed with each direct signal through a third attenuator to produce a mixed signal, each of said mixed signal being applied to a headphone having a sound pressure-frequency response having two peaks between 1.5 and 5 kHz with a level difference of 6 to 17 dB above the level of the lower frequency, the intensity ratio of said indirect to direct sound signals being varied at a value above 10 : 1 by adjusting said third attenuator to control the feeling of distance to a sound image, and said first and second attenuators being adjusted to control the feeling of direction of said sound image.

2. An out-of-head localization headphone listening device having left and right electro-acoustic transducers comprising:

means for mixing two direct sound signals supplied from a two channel stereo apparatus;

means including a reverberation supply circuit for producing an indirect sound signal by applying said mixed direct signals to said reverberation supply circuit;

attenuator means for attenuating the intensity of said indirect sound signal to control the ratio of the intensity of the attenuated indirect sound signal to said direct sound signal;

means for twofold dividing said indirect sound signal attenuated by said attenuator;

means for mixing each divided indirect sound signal with the respective direct sound signal to produce two mixed signals to be applied to said left and right electro-acoustic transducers respectively;

phase shifters of different phase characteristics interposed between said attenuator and said mixing means; and low-pass filter means for passing and mixing a part of the output of said each phase shifter with the output of the other phase shifter.

3. A headphone device having left and right electro-acoustic transducers comprising:

means for twofold dividing stereo signals of right and left channels to produce four respective direct sound signals;

means including reverberation supply circuits for applying said four direct sound signals to the respective reverberation supply circuits to produce four indirect sound signals;

means for mixing said indirect sound signals with said direct sound signals through respective attenuators to produce four mixed signals; and means for applying one of the two mixed signals of the right channel and one of the two mixed signals of the left channel to the left electro-acoustic transducer and for applying the others of said mixed signals of right and left channels to the right electro-acoustic transducer of said headphone.

4. A headphone device according to claim 3, further comprising means for controlling said attenuators to change the ratio of indirect to direct sound signals to a value above 1 : 10 to control the feeling of distance to a sound image.

5. A headphone device according to claim 3, further comprising means for applying the other of the right channel mixed signals through an attenuator means together with the application of the one of the mixed signals of the left channel to said left electro-acoustic transducer; and means for applying the other of the mixed signals of the left channel through an attenuator means together with the application of the one of the mixed signals of the right channel to said right electro-acoustic transducer.

6. A headphone device according to claim 5, further comprising means for controlling said attenuator means to change the feeling of the direction of a sound image.

7. An out-of-head localization headphone listening device having left and right electro-acoustic transducers comprising:

means for mixing two direct sound signals applied from a two channel stereo apparatus;

means including a reverberation supply circuit for producing an indirect sound signal by applying said mixed direct signals to said reverberation supply circuit;

attenuator means for attenuating the intensity of said indirect sound signal to control the ratio of the intensity of the attenuated indirect sound signal to said direct sound signal;

means for twofold dividing said indirect sound signal attenuated by said attenuator;

means for mixing each divided indirect sound signal with the respective direct sound signal to produce two mixed signals to be applied to said left and right electro-acoustic transducers respectively;

first and second attenuators; and first and second adders receiving respectively said first and second direct sound signals, said first attenuator being coupled to said second adder and said second attenuator being coupled to said first adder for mixing a respective one of said two direct sound signals with the other channel direct sound signal.

8. A headphone device according to claim 7, comprising means for adjusting said first and second attenuators to control the direction of a sound image.

* * * * *